United States Patent [19]

Clouse et al.

[11] 4,222,717

[45] Sep. 16, 1980

[54] FUEL INJECTION PUMP

[75] Inventors: Jerry A. Clouse, Washington; Richard A. Dekeyser, Edelstein, both of Ill.

[73] Assignee: Caterpillar Tractor Co., Peoria, Ill.

[21] Appl. No.: 949,317

[22] Filed: Oct. 6, 1978

[51] Int. Cl.[3] ..... F02M 59/26

[52] U.S. Cl. ..... 417/499; 123/503

[58] Field of Search ..... 123/139 AD, 139 AR; 417/494, 499

[56] References Cited

U.S. PATENT DOCUMENTS

| | | | |
|---|---|---|---|
| 1,999,330 | 4/1935 | L'Orange | 417/494 |
| 2,131,228 | 9/1938 | L'Orange | 417/494 |
| 2,569,233 | 9/1951 | Dickson et al. | 123/139 AJ |
| 2,576,451 | 11/1951 | Dickson et al. | 417/499 X |
| 3,368,491 | 2/1968 | Shook et al. | 417/494 |

FOREIGN PATENT DOCUMENTS

| | | | |
|---|---|---|---|
| 468958 | 7/1937 | United Kingdom | 417/494 |
| 630437 | 10/1949 | United Kingdom | 417/494 |

*Primary Examiner*—Leonard E. Smith

*Attorney, Agent, or Firm*—Wegner, Stellman, McCord, Wiles & Wood

[57] ABSTRACT

A fuel injection pump has a barrel with a central bore communicating through axially staggered fuel inlet and outlet ports with an outer peripheral recess in the barrel which, in cooperation with a fuel pump housing, forms an annular fuel receiving cavity about the pump barrel. A relatively large fuel reservoir in the housing communicates with the annular cavity through fuel inlet and outlet conduits in the housing, the outlet conduit being aligned with the outlet port in the pump barrel. A plunger having a scroll surface at one end is rotatably and reciprocably received in the pump barrel bore, and the scroll surface is selectively registrable with the fuel ports. A pulse shield of hardened material is disposed within the fuel reservoir in alignment with the fuel outlet conduit to deflect fuel from the outlet conduit into the main portion of the reservoir and to prevent erosion of the housing surfaces.

5 Claims, 2 Drawing Figures

FUEL INJECTION PUMP

BACKGROUND OF THE INVENTION

1. Field of the Invention

This invention relates to fuel injection pumps.

2. Description of the Prior Art

The efficiencies of prior fuel injection pumps have been limited due to the tendency of such pumps to excessively aerate fuel and to insufficiently cool fuel before delivery to an associated injection nozzle. Since fule density is inversely related to the degree of aeration and fuel temperature, the weight of fuel delivered with each stroke of a constant volume pump is necessarily relatively low when fuel temperature is high or when the fuel is excessively aerated, with a corresponding decrease in pump efficiency. Uncontrollable aeration and fuel temperature result in uncontrollable fuel delivery rates and efficiency.

Fuel is supplied to prior fuel pumps through a single- or double-ported barrel communicating with either individual fuel lines or a manifold intermediate the pump and a fuel tank. A plunger received in the barrel has a recessed scroll surface on an end, or intermediate its ends, for receipt of fuel from at least one port. Fuel is expelled from the scroll to a nozzle during an injection stroke, with excess fuel being spilled to a return line through an outlet port.

Pump barrels having a single inlet/outlet port experience two-way flow through the port, causing heating and increased aeration of fuel. Previous double-port pump barrels fed directly from relatively high temperature fuel lines result in injected fuel of undesirably low density.

One type of injection fuel pump supplies fuel to a plunger bore through two axially staggered radial ports leading from an annular cavity about the pump barrel. Fuel is received through a port on the outer circumference of the barrel and is conveyed to a pumping chamber through an axial bore in the plunger. Supply and ejection of excess fuel requires two-way flow through the axial bore resulting in undesirable aeration. Further, spilled excess fuel is relatively hot and, when supplied to the pumping chamber, reduces the density of fuel available for injection.

SUMMARY OF THE INVENTION

The present invention is directed to overcoming one or more of the problems as set forth above.

According to the present invention, a pump barrel having an outer peripheral recess is received in a housing which cooperates with the recess to form an annular fuel receiving cavity. A central bore in the pump barrel communicates with the annular cavity through first and second ports extending therebetween and receives a plunger having a recessed scroll surface at one end which selectively registers with the ports. A fuel supply deaeration chamber communicates with the annular cavity through a pair of fuel conduits in the housing. A pulse shield is disposed in the fuel supply chamber in alignment with the fuel conduits to prevent erosion of chamber walls by high pressure fuel discharged from the fuel conduits.

DESCRIPTION OF THE PREFERRED EMBODIMENT

Figure 1:
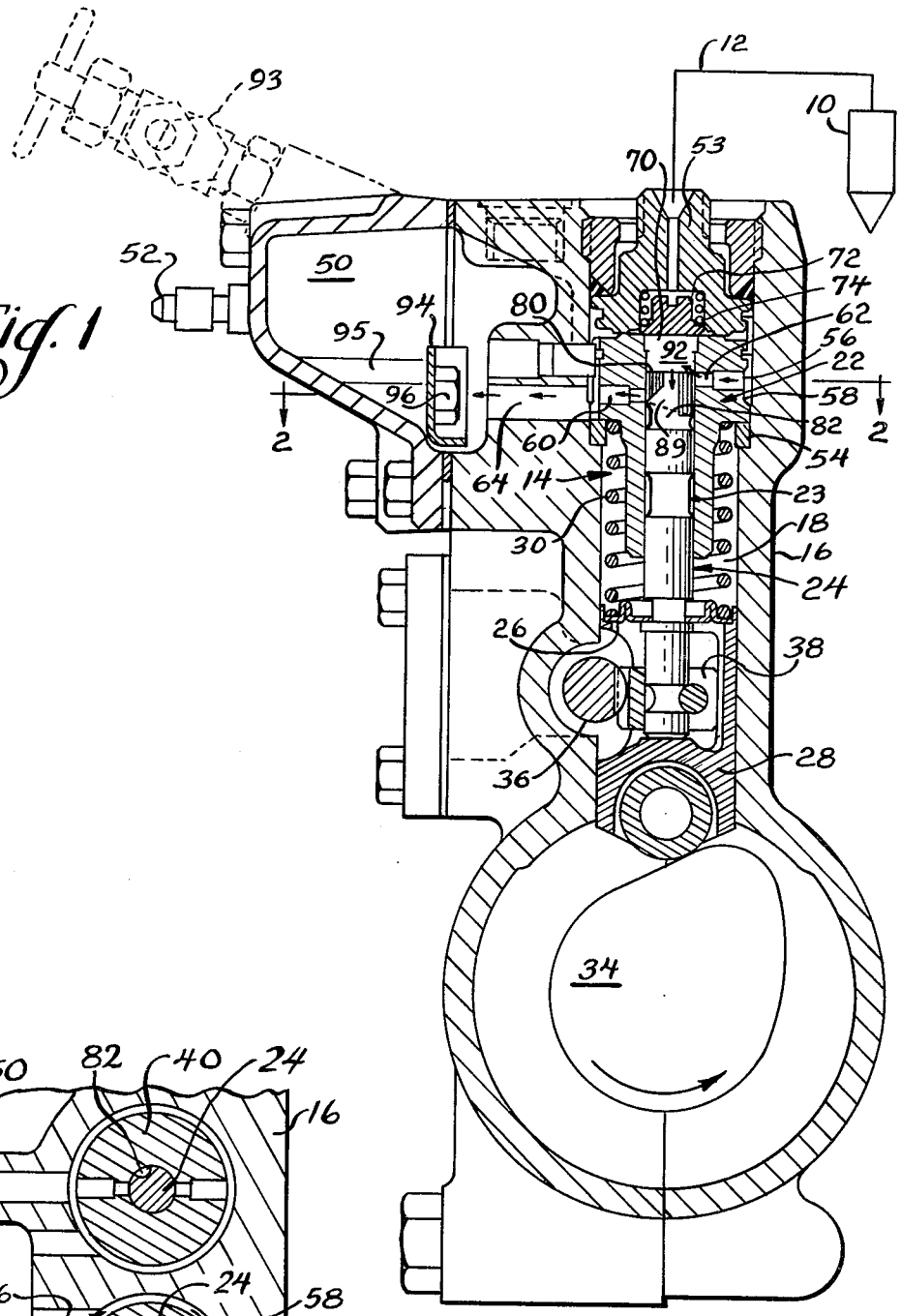
FIG. 1 is a vertical sectional view of the fuel pump of the present invention.

Referring to FIG. 1, a fuel injection nozzle 10 is supplied with fuel via a supply line 12 from a fuel pump, generally designated 14, disposed in a housing 16. The housing 16 defines a cavity 18 which receives a pump barrel 22. A bore 23 in the pump barrel 22 reciprocably and rotatably receives a plunger 24 which in turn mounts an annular retainer 26 carried by a lifter 28. A helical spring 30 is disposed between the retainer 26 and a shoulder on the exterior of the pump barrel 22, and biases the lifter 28 toward the surface of a rotating cam 34.

Figure 2:
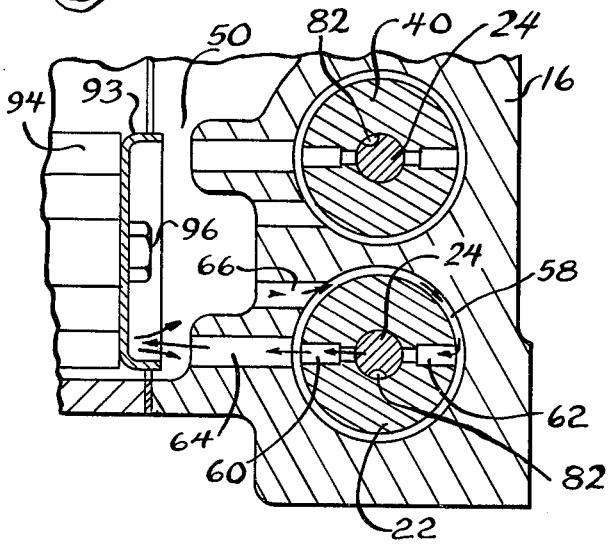
FIG. 2 is a horizontal sectional view of the fuel pump of FIG. 1, taken along line 2—2 of FIG. 1.

A rack 36 engages a pinion 38 on the plunger 24 to maintain the plunger 24 in a predetermined position of relative rotation, as described below. Conventionally, a single pump assembly is provided for each cylinder of a multi-cylinder engine; FIG. 2 illustrates a second pump barrel 40 adjacent the pump barrel 22.

A fuel reservoir or gallery 50 is formed in and extends laterally of the housing 16. The fuel reservoir 50 receives pressurized fuel from a main supply source through a fitting 52 at a pressure of between about 25 and 50 psi at which the fuel is maintained while within the reservoir 50. A return line with a combination orifice, bypass valve and manual bleed valve (none shown) extends from the reservoir 50 to the main fuel supply to allow air and excess fuel to be removed from the reservoir without loss of pressure from the reservoir 50.

The pump barrel 22 is retained in the housing 16 between a stationary fuel outlet conduit 53 and an annular stop 54.

An annular recess 56 about the outer periphery of the pump barrel 22 cooperates with the wall of the housing 16 to form an annular cavity 58 about the pump barrel 22. First and second radial bores define a spill port 60 and a fill port 62 in the pump barrel 22 and place the central bore 23 and the annular cavity 58 in communication. The port 60 is aligned with a fuel outlet conduit 64 to place the bore 23 in communication with the fuel reservoir 50. The annular cavity 58 communicates with the reservoir 50 through a fuel inlet conduit 66 in the housing 16.

Preferably, the port 62 is disposed circumferentially from the port 60 at an angle of 180° and is spaced axially from the port 60 toward the outlet end 70 of the bore 23. The outlet end 70 of the bore 23 communicates with the line 12 via a conventional scratched check valve 72 which seats against the pump barrel 22 and which is yieldably urged thereagainst by a spring 74 between the valve 72 and the conduit 53.

The plunger 24 includes at its uppermost end 80 a scroll defined by a groove 82 of a diameter less than that of the bore 23 extending about the circumference of the plunger 24. The groove 82 has a varying axial length on the plunger 24, as shown by the dotted lines. The plunger 24 may be set in a predetermined angular position within the bore 23 by rotation of the pinion 38 by the rack 36 in a conventional manner, whereby a portion of the scroll groove 82 of desired axial length may be placed in registration with the port 60.

In operation, reciprocating movement of the plunger 24 is effected by rotation of the cam 34, with upward movement of the plunger 24 comprising an injection stroke and downward movement of the plunger 24 comprising a fill stroke, wherein a pump volume 89 defined by the scroll groove 82 and the upper portion 92 of the barrel bore 23 is filled with fuel for the next injection stroke. In FIG. 1, the plunger 24 is shown midway through its injection stroke.

In the configuration of FIG. 1, the volume 89 is filled with fuel under maximum pressure due to blocking of the ports 60 and 62, and the fuel can exit the chamber 89 only by flow through the check valve 72, the conduit 53 and the line 12. As the plunger continues its upward stroke, the scroll groove 82 aligns with the port 60, resulting in flow of fuel through the port 60 in the direction of the arrows in FIGS. 1 and 2 due to the relatively great pressure drop between the chamber 92 and the reservoir 50, whereupon fuel pressure in the line 12 urges the check valve 72 to seat against the pump barrel 22. Fuel remaining in the barrel flows to the reservoir 50 through the port 60 and the conduit 64.

After reaching its apex, the plunger 24 begins its downward stroke and draws fuel from the reservoir 50 through the conduit 66 and the port 62 to the scroll groove 82 and the chamber 89. Flow from the reservoir 50 through the conduit 64 and the port 60 is minimal due to inertia of high pressure fuel remaining therein from the preceding upward plunger stroke.

Relatively cool fuel flowing from the reservoir 50 to the port 62 follows a relatively lengthy route through the conduit 66 and the annular cavity 58, resulting in further cooling and consequent densification, allowing the plunger stroke to convey a relatively great weight of fuel to the pump nozzle 10, thereby enhancing pump efficiency. Air escaping from fuel in the reservoir 50 returns to the fuel supply source through a valve 93 leading to a return line (not shown).

Excess fuel discharged through the spill port 60 and the conduit 64 is under a relatively high pressure and at a correspondingly high velocity. A baffle 94 of hardened metal is secured to an upstanding projection 95 in the reservoir 50, as by a hex head bolt 96. The baffle 94 deflects high pressure, high velocity fuel into the main chamber of the reservoir 50, and prevents erosion of the housing's surfaces. The fuel exiting the conduit 64 is at a high temperature, and is cooled by mixing with relatively cool fuel in the relatively large volume of the reservoir 50, thereby displacing relatively hot fuel through the valve 93. Any air entrained in the fuel is dispersed due to the sudden decompression of the fuel. Dispersion of entrained air is aided by the relatively long residence time of the fuel in the reservoir.

Fuel flow through any of the ports 60 and 62 or the conduits 64 and 66 is in one direction only, except for minimal flow through the conduit 64 and the port 60 during the downward fill stroke of the plunger. This predominately one-way flow allows cooling of fuel and minimizes fuel aeration which, in turn, enhances fuel density and, therefore, pump efficiency.

The relatively large volume of the reservoir 50 and, to a lesser extent, that of the cavity 58 relative to the volume of the injection chamber 89 effectively maintains the fuel temperature and entrained air content at a uniformly low level, thereby minimizing fluctuations in fuel density, resulting in the delivery of a consistent amount of fuel to the injection nozzle 10 on each stroke.

It has been found that the features of the invention described herein may increase the volumetric efficiency of the pump from about 65% to 95%.

The embodiments of the invention in which an exclusive property or privilege is claimed are defined as follows:

1. A fuel injection pump, comprising:

(a) a pump barrel having a central bore and a radial inlet port and a radial outlet port;

(b) a housing receiving said pump barrel and cooperating therewith to define an annular fuel receiving cavity about said barrel, said ports extending between said cavity and said central bore, said inlet port being spaced circumferentially from said outlet port and directed generally oppositely thereof;

(c) a plunger received by said pump barrel bore and having a surface at one end for selective registration with said ports, said plunger cooperating with said pump barrel and said housing to form a fuel injection chamber;

(d) a fuel supply and deaeration chamber in said housing spaced from one side of said pump barrel generally oppositely of said inlet port; and (e) a pair of fuel conduits in said housing extending between said annular cavity and said fuel chamber, one of said fuel conduits being linearly aligned with and adjacent to said outlet port and said fuel chamber and the other of said conduits communicating with said annular cavity without alignment with either of said ports.

2. A fuel injection pump, comprising:

(a) a pump barrel having a central bore and an outer peripheral recess with a radial inlet port and a radial outlet port extending between said recess and said central bore;

(b) a housing receiving said pump barrel and cooperating with said peripheral recess to define an annular fuel-receiving cavity about said barrel, said inlet port being spaced circumferentially from said outlet port and directed generally oppositely thereof;

(c) a plunger received by said pump barrel bore and having a surface at one end for selective registration with said ports, said plunger cooperating with said pump barrel and said housing to form a fuel injection chamber;

(d) a fuel supply and deaeration chamber in said housing spaced from one side of said pump barrel generally oppositely of said inlet port; and (e) a pair of fuel conduits in said housing extending between said annular cavity and said fuel chamber, one of said fuel conduits being linearly aligned with and adjacent to said outlet port and said fuel chamber and the other of said conduits communicating with said annular cavity without alignment with either of said ports.

3. The fuel pump of claim 1 wherein said fuel chamber has a baffle disposed therein in alignment with one said fuel conduit for deflection of fuel received therefrom.

4. A fuel injection pump, comprising:

(a) a housing having a bore;

(b) a pump barrel received in said bore, said pump barrel having a central axial bore, said pump barrel cooperating with said housing bore to form an annular cavity about said pump barrel, said pump barrel further having axially and circumferentially spaced generally radial inlet and outlet ports communicating with said cavity and with said central axial bore, said inlet port being directed generally oppositely of said outlet port;

(c) a fuel reservoir in said housing spaced from one side of said pump barrel generally oppositely of said inlet port;

(d) a linear first conduit in said housing communicating with said fuel reservoir and with said annular cavity, said first conduit being linearly aligned with and adjacent to said outlet port and said reservoir;

(e) a second conduit in said housing at said one barrel side circumferentially spaced from said first conduit and communicating with said fuel reservoir and with said annular cavity without alignment with said inlet port;

(f) a plunger reciprocably and rotatably received by said pump barrel bore and having a scroll surface at one end for selective reigstration with said ports; and (g) a baffle plate secured to said housing within said fuel reservoir and aligned with said first conduit for impingement thereon of fuel flowing from said first conduit to said reservoir.

5. The fuel pump of claim 4 wherein said inlet port is spaced axially from said outlet port toward said fuel injection chamber.

* * * * *